US008066885B2

(12) United States Patent
Ravishankar et al.

(10) Patent No.: US 8,066,885 B2
(45) Date of Patent: Nov. 29, 2011

(54) PROCESS FOR THE REMOVAL OF IMPURITIES FROM CARBONATE MINERALS

(75) Inventors: Santhanjheri A. Ravishankar, Shelton, CT (US); Josanlet C. Villegas, West Haven, CT (US); Bing Wang, Brookfield, CT (US)

(73) Assignee: Cytec Technology Corp., Wilmington, DE (US)

( * ) Notice: Subject to any disclaimer, the term of this patent is extended or adjusted under 35 U.S.C. 154(b) by 286 days.

(21) Appl. No.: 11/968,850

(22) Filed: Jan. 3, 2008

(65) Prior Publication Data

US 2008/0164140 A1 Jul. 10, 2008

(51) Int. Cl.
*B03C 1/01* (2006.01)

(52) U.S. Cl. ..... 210/695; 210/684; 210/729; 204/554; 204/557; 209/8; 209/214; 209/215; 423/419.1

(58) Field of Classification Search ..... 210/695, 210/684, 729; 209/8, 214, 215; 204/557, 204/554; 423/419.1
See application file for complete search history.

(56) References Cited

U.S. PATENT DOCUMENTS

| | | | | |
|---|---|---|---|---|
| 2,297,440 | A | 9/1942 | Szucs | |
| 3,627,678 | A | 12/1971 | Marston et al. | |
| 3,914,385 | A * | 10/1975 | Slade | 423/340 |
| 3,929,627 | A * | 12/1975 | Frangiskos et al. | 209/9 |
| 3,980,240 | A | 9/1976 | Nott | |
| 3,990,642 | A | 11/1976 | Nott | |
| 4,078,004 | A | 3/1978 | Schlaefer et al. | |
| 4,094,804 | A * | 6/1978 | Shimoiizaka | 252/62.52 |
| 4,125,460 | A | 11/1978 | Nott et al. | |
| 4,356,098 | A * | 10/1982 | Chagnon | 252/62.51 R |
| 4,406,865 | A * | 9/1983 | Fuller | 423/10 |
| 4,629,556 | A | 12/1986 | Yoon et al. | |
| 4,643,822 | A | 2/1987 | Parsonage | 209/8 |
| 4,834,898 | A | 5/1989 | Hwang | |
| 4,871,466 | A | 10/1989 | Wang et al. | |
| 4,906,382 | A | 3/1990 | Hwang | |
| 4,929,343 | A | 5/1990 | Wang et al. | |
| 4,995,965 | A * | 2/1991 | Mehaffey et al. | 209/166 |
| 5,328,880 | A * | 7/1994 | Lampert et al. | 501/148 |
| 5,720,873 | A * | 2/1998 | Klingberg et al. | 209/166 |
| 5,957,298 | A * | 9/1999 | Buske et al. | 209/39 |
| 5,961,055 | A | 10/1999 | Lehtinen | |
| 6,143,065 | A | 11/2000 | Freeman et al. | |
| 6,269,952 | B1 | 8/2001 | Watt et al. | |
| 7,393,462 | B2 * | 7/2008 | Gorken et al. | 252/61 |

FOREIGN PATENT DOCUMENTS

| | | |
|---|---|---|
| EP | 0522856 B1 | 9/1994 |
| GB | 1519528 | 4/1976 |
| KR | 2007 014821 | 1/2007 |
| WO | WO/00/51941 | 9/2000 |
| WO | 02/066168 | 8/2002 |
| WO | WO/02/066168 A1 | 8/2002 |

OTHER PUBLICATIONS

International Search Report and Written Opinion of PCT/US2007/086498 mailed Jun. 26, 2008.

P. Tartaj et al., "The Preparation of Magnetic Nanoparticles for Applications in Biomedicine", J. Phys. D: Appl. Phys. 36, (2003) R182-R197.

* cited by examiner

*Primary Examiner* — Tony G Soohoo
*Assistant Examiner* — David C Mellon
(74) *Attorney, Agent, or Firm* — Charles E. Bell; Elizabeth A. Galletta

(57) ABSTRACT

A process for the beneficiation of carbonate mineral substrates by magnetic separation is defined herein wherein a phosphorus or nitrogen containing organic compound or reagent and a plurality of magnetic particles are intermixed with a carbonate containing mineral substrate, a magnetic field is applied to the mixture and a value mineral is thereby separated from a non-value mineral.

24 Claims, No Drawings

PROCESS FOR THE REMOVAL OF IMPURITIES FROM CARBONATE MINERALS

BACKGROUND

1. Field of the Invention

The present invention relates to the field of beneficiation of carbonate mineral substrates by removing undesired impurities. Specifically, the present invention relates to a method of beneficiation of carbonate ores using a combination of magnetic microparticles and a mineral-active compound containing a N or P functionality.

2. Description of the Related Art

Beneficiation is a term used in the mining industry to refer to various processes for purifying mineral substrates (such as mineral ores) to obtain value minerals. Beneficiation typically involves separating the desired or "value" minerals from other less desirable or "non-value" mineral(s) that may be present in the mineral substrate. In many cases, the degree of separation obtained strongly influences the quality of the beneficiated product. For example, value minerals such as calcium carbonate are used as pigments and fillers in a variety of end applications, e.g., coatings and fillers in paper, paint, plastic, ceramics, etc. In such applications, desirably higher levels of whiteness or brightness are typically associated with lower levels of impurities. However, carbonate minerals often contain a variety of discoloring minerals such as feldspar, orthoclase, chlorite, silica, anatase, micas such as muscovite and biotite, clays and iron phases. Also, minerals with relatively low impurity levels are often desired in other applications, such as in the electronics, optics and biomedical fields.

Some mineral separation processes involve the use of magnetic reagents and strong magnetic fields. PCT Publication WO 02/066168 discloses surface-functionalized magnetic particles that are said to be useful as magnetic reagents for mineral beneficiation. The magnetic particles are said to be at least comparable in size with the mineral particles, and thus it is apparent that the amount of material present on the surfaces of the magnetic particles is only a small part of the magnetic reagent. U.S. Pat. Nos. 4,834,898 and 4,906,382 disclose magnetizing reagents that are said to comprise water that contains particles of a magnetic material, each of which has a two layer surfactant coating including an inner layer and an outer layer. The inner and outer surfactant layers on the magnetic particles are said to be monomolecular and are different.

In prior magnetic separation processes it has been found that improved beneficiation has often been observed as the particle size of the magnetic microparticles is decreased. Thus, it has been desirable in certain applications, such as in kaolin beneficiation, to use magnetic microparticles with the smallest practical particle size

SUMMARY OF THE INVENTION

An object of the current invention is to provide an improved process for the beneficiation of carbonate containing mineral substrates such as carbonate ores using a mixture of magnetic microparticles and a mineral active compound containing a N or P functionality.

DETAILED DESCRIPTION OF THE PREFERRED EMBODIMENTS

An embodiment provides a process for the beneficiation of carbonate mineral substrates by magnetic separation, comprising intermixing a carbonate-containing mineral substrate, a plurality of magnetic microparticles and a reagent of formula I or formula II, or combinations of formula I and formula II to form a mixture. The reagent of formula I preferably comprises R1R2R3 M and the reagent of formula II preferably comprises R1R2R3R4 $M^+X^-$, where M is N or P, X is an anionic counterion, and R1, R2, R3, and R4 individually comprise H or an organic moiety containing from about 1 to about 50 carbons or in which at least two of R1, R2, R3, and R4 form a ring structure containing from 1 to 50 carbon atoms and wherein at least one of the R1, R2, R3, and R4 groups must be an organic moiety containing from 1 to 50 carbons or wherein at least two of the R1, R2, R3, and R4 groups form a ring structure containing from 1 to 50 carbon atoms. A magnetic field is applied to the mixture to thereby separate a value mineral from a non-value mineral.

The plurality of magnetic microparticles and the reagent of the formula I or formula II are preferably added to the carbonate mineral substrate in a weight ratio of magnetic microparticles to reagent of the formula (I) or (II) in the range of about 10:1 to about 1:10, and most preferably present in a weight ratio of from about 5:1 to about 1:5.

The reagents of formula (I) or formula (II) comprise organic nitrogen (N) or phosphorus (P) containing molecules wherein the N or the P is capable of being quaternary or in a protonated cationic form.

The reagents of the formula (I) may be primary, secondary or tertiary amines or phosphine derivatives. Examples of such reagents include, but are not limited to, methyl-bis(2-hydroxypropyl)-cocoalkyl ammonium methyl sulphate, dimethyl didecyl ammonium chloride, dimethyl-di(2-ethylhexyl)-ammonium chloride, dimethyl-(2-ethylhexyl)-cocoalkyl ammonium chloride, dicocoalkyl dimethyl ammonium chloride, and n-tallow alkyl-1,3-diamino propane diacetate, Arquad 2C (dimethyl dicocoalkyl ammonium chloride) and a combination of Duomac T (N-tallow alkyl-1,3-diamino propane diacetate) and Ethomeen 18/16 (long-chain alkylamine+50 EO).

The reagents of the formula (II) may be quaternary salts in which R1, R2, R3, and R4, individually comprises organic moieties containing from 1 to 50 carbons or in which at least two of the R1, R2, R3, and R4 form a ring structure containing from 1 to 50 carbon atoms, or they may be simple salts of an amine or phosphine precursor in which at least one of R1, R2, R3, and R4 is H. At least one of R1, R2, R3, and R4 must be an organic moiety containing from 1 to 50 carbons or at least two of R1, R2, R3, and R4 form a ring structure containing from 1 to 50 carbon atoms. Preferably at least two of R1, R2, R3, and R4 contains an organic moiety containing from 1 to 50 carbons or any two of R1, R2, R3, and R4 forms a ring structure.

R1, R2, R3, R4, each comprise various organic chemical groups, including without limitation branched and unbranched, substituted and unsubstituted versions of the following: alkyl e.g., $C_1$-$C_{50}$ alkyl or alkenyl, cycloalkyl or bicycloalkyl, alkylene oxide, (e.g., $((CH_2)_n—O—)_m$, where n and m are each individually in the range of 1 to 6), polycycloalkyl, alkenyl, cycloalkenyl, bicycloalkenyl, polycycloalkenyl, alkynyl, aryl e.g., $C_6$-$C_{20}$ aryl, bicycloaryl, polycycloaryl, heteroaryl, and aralkyl e.g., $C_7$-$C_{20}$ aralkyl. It is preferred that at least one of R1, R2, R3, and R4 comprises a $C_5$-$C_{20}$ alkyl, a $C_6$-$C_{12}$ aryl, or a $C_7$-$C_{12}$ aralkyl group. Examples of suitable R groups include, but are not limited to butyl, pentyl, hexyl, octyl, dodecyl, lauryl, 2-ethylhexyl, tallow, heptadecenyl, oleyl, eicosyl, phenyl, tolyl, naphthyl and hexylphenyl. Preferred such reagents include dimethyl didecyl ammonium chloride, dimethyl dicycloalkyl ammonium chloride, dimethyl dilauryl ammonium chloride, dimethyl distearyl ammonium chloride, dimethyl ditallow alkyl ammonium chloride and corresponding methyl sulphate salts In another preferred embodiment any two or more of R1, R2, R3, and R4 form a ring. The ring may also comprise an additional heteroatom such as N, O or S. Such heterocyclic compounds include, but are not limited to, (benz)imidazoles, (benz)imidazolines, (benz)oxazoles, (benz)oxazolines, morpholines, and piperidines. The heterocyle may optionally be alkylated or ethoxylated or propoxylated.

Preferred heterocyclic compounds use as the reagent in the present invention are imidazoles, imidazolines, oxazole, oxazolines, and morpholines. Especially preferred are heterocyclic compounds which contain a $C_5$-$C_{20}$ alkyl or alkenyl, a $C_6$-$C_{12}$ aryl, or a $C_7$-$C_{12}$ aralkyl group which may be attached at any point in the ring. In those preferred embodiment, wherein the reagent of formula I or II is an imidazoline or imidazole derivative. Examples of suitable imidazolium compounds include are Variquat 56, (1H-Imidazolium, 1-Ethyl-2-8-Heptadecenyl)-4,5-dihydro-ethyl sulfate), Varine O (1H-Imidazole-1-Ethanol-2-(8-Heptadecenyl)-4,5-dihydro) and Varisoft 3696 (Imidazolium, 1-Ethyl-4,5-dihydro-3-(2-Hydroxyethyl-2-(8-Heptadccenyl)-ethyl sulfate) which are commercially available from Degussa, tall oil hydroxyethylimidazoline (Formula 2), and tall oil ethylene bis-imidazoline (Formula 4).

In a preferred embodiment) reagents of formula I include secondary or tertiary amines and their salts. Particularly preferred are fatty amine derivatives which contain at least one $C_5$-$C_{20}$ alkyl or alkenyl, $C_6$-$C_{12}$ aryl, or $C_7$-$C_{12}$ aralkyl group.

Primary, secondary or tertiary amines may be used alone or in salt form by neutralization with an acid which may be a mineral acid such as sulfuric or hydrochloric acid or an organic acid such as acetic, propionic, or glutaric acid. Secondary, tertiary and heterocyclic amines are preferred.

Examples of specific reagents of the formula (I) include fatty amine salts such as Aero® 3100C a primary fatty ammonium acetate salt Aero® 3030C a primary fatty ammonium acetate salt, Aeromine® 8625A a primary tallow amine acetate salt, and Aeromine® 8651 an amine condensate which are commercially available amines from Cytec Industries Inc., W. Paterson, N.J.

Examples of specific reagents of the formula (II) include tetraalkylammonium salts such as tetraethylammonium bromide, tetrabutylammonium bromide, hexadecyltrimethylammonium bromide, butyl undecyl tetradecyl oleyl ammonium chloride, Cyastat® SN (stearamidopropyl dimethyl-beta-hydroxyethyl ammonium nitrate) a commercially available quaternary ammonium surfactant from Cytec Industries Inc., and Adogen 462-75%, dicocoalkyldimethylammonium chloride, and quaternary AM High Flash TSCA, a tetraalkyl ammonium chloride both from Degussa, or trialkylaryl ammonium salts such as benzyltrimethyl ammonium hydroxide are also preferred.

In another preferred embodiment the reagent of formula (I) or (II) is a morpholine derivative. Morpholine compounds such as tall-oil-amidomorpholine Formula 3 are suitable. The R group is preferrably a $C_5$-$C_{20}$ alkyl or alkenyl, a $C_6$-$C_{12}$ aryl, or a $C_7$-$C_{12}$ aralkyl group.

In another preferred embodiment, the reagent of formula (I) or (II) is an oxazoline or oxazole derivative. Oxazolines, such as tall oil 2-hydroxyl-3-methyloxazolidine are suitable. The R group is preferrably a $C_5$-$C_{20}$ alkyl or alkenyl, a $C_6$-$C_{12}$ aryl, or a $C_7$-$C_{12}$ aralkyl group.

In another preferred embodiment, the reagent of formula (I) or (II) is a phosphonium derivative. Examples of phosphorus containing reagents of formula (I) or (II) include tetralkyl phosphonium salts such, for example tributyltetradecylphosphonium chloride, trioctyltetradecylphosphonium chloride, trimethylalkylphosphonium halides, benzyltrialkylphosphonium halides, etc. It is preferred that at least one of the R1R2R3R4 groups is a $C_5$-$C_{20}$ alkyl or alkenyl, a $C_6$-$C_{12}$ aryl, or a $C_7$-$C_{12}$ aralkyl group.

The magnetic microparticles may be magnetite particles and may be obtained from commercial sources and/or made by techniques known to those skilled in the art (see, e.g., P. Tartaj et al., J. Phys. D: Appl. Phys. 36, (2003) R182-R197 and references contained therein). Those skilled in the art will understand that so-called ferroso-ferric oxide particles (typically prepared by a process of coprecipitation of iron (2) and iron (21) salts) are examples of magnetic microparticles suitable for use in the present invention.

Preferred magnetic microparticles have an average diameter of less than 200 microns. In the instant invention, any magnetic particles may be used. They may be nanoparticles, for example of from about 0.001 micron (1 nanometer) to 0.02 micron (20 nanometers) or microparticles with diameters up to about 200 microns. Preferably the particle sizes are above 0.01 micron (10 nm), more preferably above 0.1 micron and most preferably above 1.0 micron in diameter. Thus, good results may be obtained using magnetic microparticles having an average diameter of from about 1 to about 100 microns. These are preferred. The plurality of magnetic microparticles may have a unimodal or polymodal (e.g., bimodal) particle size distribution. When nanoparticles are used, they are preferably used in an agglomerated form to give an agglomerated particle size above 0.01 micron (10 nm), more preferably above 0.1 micron and most preferably above 1.0 micron in diameter.

In any given situation, the size of the magnetic microparticles may be selected on the basis of various practical considerations, such as cost, throughput, carbonate mineral substrate to be treated and the degree of beneficiation desired. Thus, for a example, in most applications a magnetic reagent that comprises magnetic microparticles having an average particle size between about 0.001 and 100 microns may be used, more preferably the average particle size is between from about 0.1 micron to about 100 microns and most preferably is between from about 1.0 micron to about 50 microns.

The sizes of magnetic microparticles may be determined by measuring their surface areas using BET $N_2$ adsorption techniques. For example, Table 1 below illustrates correlations between magnetic microparticle diameters (in units of nanometers, m) and surface areas (in units of square meters per gram, $m^2/g$) as determined by BET $N_2$ adsorption techniques known to those skilled in the art.

TABLE 1

| Diameter (nm) | Surface Area ($m^2/g$) |
|---|---|
| 4 | 300 |
| 8 | 150 |
| 20 | 60 |
| 200 | 5 |
| 10,000 | 0.1 |

The conductivity of a magnetic reagent may vary from about 0 to about 50 milliSiemans/cm but is preferably less than about 2 milliSiemens/cm. Iron oxide in the magnetic microparticles may comprise various oxides over a range of formulaic representations from FeO to $Fe_2O_3$, which may be generally represented as $Fe_xO_y$ where x and y may each individually vary from one to four. One or more water molecules may be associated with each iron atom. For example, each iron atom may be associated with from about one to about 10 water molecules, more preferably from about one to about 7 water molecules, most preferably from about one to about 4 water molecules. Optionally, the iron oxide may comprise hydroxides of iron, e.g., one or more oxygen atoms of $Fe_xO_y$ may be replaced by hydroxyl (OH) group(s).

The carbonate mineral substrate that is intermixed with the reagent of formula (I) or formula (II) and the magnetic microparticles may be a substrate that contains both "value" minerals and "non-value" minerals. In this context, the term "value" mineral refers to the mineral or minerals that are the primary object of the beneficiation process, e.g., the mineral from which it is desirable to remove impurities. The term "non-value" mineral refers to the mineral or minerals for which removal from the value mineral is desired, e.g., impurities in the value mineral. Typically, the amount of value mineral in the mineral substrate is substantially larger than the amount of non-value mineral. The terms "value" mineral and "non-value" mineral are terms of art that do not necessarily indicate the relative economic values of the constituents of the mineral substrate. For example, it may be desirable to beneficiate a mineral substrate that comprises about 97-98% calcium carbonate, the rest being impurities.

The carbonate mineral substrate and the magnetic microparticle and reagents of formula (I) and (II) may be intermixed in various ways, e.g., in a single stage, in multiple stages, sequentially, reverse order, simultaneously, or in various combinations thereof. For example, in an embodiment, the various components e.g., magnetic microparticles, reagent of the formula (I) or (II), optional ingredients such as water, dispersant, etc. to form a pre-mix, then intermixed with the carbonate mineral substrate. In another embodiment, the process of the present invention is carried out by separately and sequentially intermixing the reagent of formula (I) or formula (II), and the magnetic microparticles with the carbonate mineral substrate. For example, the magnetic microparticles may be added to the carbonate mineral substrate, followed by the addition of the reagent of the formula (I) or (II), Alternatively the magnetic microparticles and the reagent of the formula (I) or (II) may be added simultaneously (without first forming a premix) to the carbonate mineral substrate. Various modes of addition have been found to be effective.

The amount of reagent of formula (I) or formula (II) and magnetic microparticles intermixed with the carbonate mineral substrate is preferably an amount that is effective to beneficiate the mineral substrate to thereby separate a value mineral from a non-value mineral upon application of a magnetic field. Since the amounts of the magnetic microparticles and the reagent of the formula (I) or formula (II) in the magnetic reagent may vary depending on, e.g., the amount of water (if any) in the magnetic reagent and/or whether the components are added separately or as a pre-mix, it many cases it is preferable to determine the total amount of a reagent of formula (I) or formula (II) and magnetic microparticles to be intermixed with the carbonate mineral substrate on the basis of the amounts of the individual components (e.g., the magnetic microparticles and the reagent of the formula (I) or formula (II)). Thus, the components are preferably intermixed with carbonate mineral substrate in an amount that provides a dose of the reagent of the formula (I) or formula (II) in the range of from 0.1 kilograms per ton (Kg/T) to about 10 Kg/T based on the carbonate mineral substrate, more preferably in the range of about 0.25 Kg/T to about 6 Kg/T. The components are preferably intermixed with carbonate mineral substrate in an amount that provides a dose of the magnetic microparticles in the range of from about 0.005 Kg/T to about 10 Kg/T based on mineral substrate, more preferably in the range of from about 0.25 Kg/T to about 6 Kg/T.

Beneficiation of the mixture formed by intermixing the carbonate mineral substrate and the reagent of formula (I) or formula (II) and the magnetic microparticles is preferably conducted by applying a magnetic field to the mixture to thereby separate the value mineral(s) from the non-value mineral(s). The mixture (comprising the carbonate mineral substrate and the reagent of formula (I) or formula (II) and the magnetic microparticles) is referred to as a "slurry" herein. The magnetic field may be applied to the slurry in various ways. For example, in an embodiment, separation is accomplished by passing the slurry through a high gradient magnetic separator. Various high gradient magnetic separators are those that exhibit a magnetic flux greater than or equal to about 2.2 Tesla, are known to those skilled in the art and may be obtained from commercial sources. An example of a high gradient magnetic separator is the apparatus sold under the tradename Carpco Cryofilter® (Outokumpu Technologies, Jacksonville, Fla.). High gradient magnetic separation is a process generally known in the art, and is described, e.g., in U.S. Pat. Nos. 4,125,460; 4,078,004 and 3,627,678. In general, the separation involves applying a strong magnetic field to the slurry while passing the slurry through a steel matrix having an open structure (e.g. stainless steel wool, stainless steel balls, nails, tacks, etc.). The retention time in the magnet matrix and the magnet cycle may be varied as desired, according to standard methods.

As another example, in an embodiment, separation is accomplished by passing the slurry through a low intensity magnetic separator. Various low intensity magnetic separators are known to those skilled in the art and may be obtained from commercial sources. An example of a preferred low intensity magnetic separator is an apparatus which exhibits a magnetic flux up to about 2.2 Tesla, preferably from about 0.1 Tesla to about 2.2 Tesla, more preferably from about 0.1 Tesla to about 1 Tesla and most preferably from about 0.1 to about 0.7 Tesla. Low gradient magnetic separation is a process generally known in the art, and is described, e.g., in U.S. Pat. Nos. 5,961,055 and 6,269,952. In general, the separation involves applying a weak magnetic field (from 0.01 Tesla to 0.7 Tesla) to the slurry while passing the slurry through a steel matrix having an open structure. Generally, low intensity magnetic separators are described as those used in removing tramp iron, e.g., stainless steel wool, stainless steel balls, nails, tacks, etc. that are strongly ferromagnetic in nature. As with the high gradient magnetic separation, the retention time for low intensity separation in the magnet matrix and the magnet cycle may be varied as desired, according to standard methods.

The reagent of formula (I) or (II) is preferably selected to achieve a degree of separation between the value mineral and the non-value mineral that is greater than the degree of separation obtained in the absence of reagent of formula (I) or (II). More preferably, the degree of separation is at least about 10% greater, even more preferably at least about 25% greater, even more preferably at least about 50% greater, than a comparable degree of separation achieved using no reagent of the formula (I) or (II) is used. Degree of separation is expressed as a percentage calculated as follows: Degree of separation (%)= (Wt. % Insolubles Feed−Wt. % Insolubles Product)×100/Wt. % Insolubles Feed., where insolubles are the acid insoluble (non-carbonate) mineral fraction present in the carbonate mineral substrate.

Customarily, the carbonate mineral substrate is already provided as a slurry, for example as a crushed or milled powder dispersed in water. The particle size is usually less than 1 mm. Preferably, the slurry of carbonate ore is conditioned prior to applying the magnetic field. "Conditioning" is a term used in the art to refer to various processes for imparting shear or mixing to a mineral substrate in an aqueous environment. Any type of mixing device may be used. Any type of rotor device (e.g., rotor-stator type mill) capable of imparting high shear to the mixture of the mineral substrate and the magnetic reagent may be used. The high shear may be achieved using a rotor device operating at a rotor blade tip speed of at least about 20 feet per second, and usually in a range of about 50 to about 200 feet per second. A preferred rotor device is a mill capable of achieving a rotor tip speed of about 125 to about 150 feet per second. Appropriate rotor devices include rotor-stator type mills, e.g., rotor-stator mills manufactured by Kady International (Scarborough, Mass.) (herein referred to as a "Kady mill") and rotor-stator mills manufactured by Impex (Milledgeville, Ga.) (herein referred to as an "Impex mill"); blade-type high shear mills, such as a Cowles blade-type mills (Morehouse Industries, Inc., Fullerton, Calif.); and high shear media mills, such as sand grinders. The slurry is preferably conditioned for a time sufficient to enhance the subsequent magnetic separation step, without unduly reducing the quality of the resulting value mineral. Conditioning times may vary, depending in many cases on the nature of the device used to impart the shear.

At any point prior to the application of the magnetic field, the pH of the carbonate mineral substrate may be adjusted, e.g., preferably to a pH in the range of about 6 to about 11, most preferably between 7 and 9.

Prior to application of the magnetic field, the solids level of the slurry may be adjusted to the desired concentration which is usually in the range of greater than 0% to about 70%, more preferably from about 20% to about 60%, and most preferably from about 20% to about 45%, by weight based on total weight.

After magnetic separation, the resulting beneficiated product may be subjected to additional processing steps in order to provide the separated value mineral(s) and non-value mineral (s) in the form desired. Thus, any desired processing steps may be performed on the resultant beneficiated product. For example, the beneficiated product may be flocculated, e.g., to produce a flocculated high purity carbonate product or a flocculated reduced-impurities carbonate product. The beneficiation process may further comprise dewatering the fractionated, flocculated, slurry as is known in the art.

EXAMPLES

Preparation of Reagents

Formulae 1 to 5

Formula 1

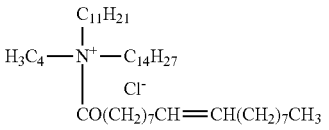

Butyl undecyl tetradecyl oleyl ammonium chloride ($R1R2R3R4N^+X^-$)

Twelve and one half grams (12.5 g) (0.17 mole) butyl amine is dissolved in 150 ml DMF/KOH solution, 40 g (0.17 mole) undecyl bromide, 40 g (0.17 mole) tetradecyl chloride is added, followed by 51 g (0.17 mole) oleyl chloride. The reaction mixture is heated to 60° C. overnight. 65 g white precipitate is filtered and collected. The precipitate is dried by vacuum strip to obtain 50 g product.

Reagents Derived from Tall Oil.

Formula 2

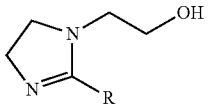

Tall oil hydroxyethyl imidazoline

To a 250 ml three-necked round bottom flask fitted with Barrett distillation receiver with condenser on the top is added 20.8 g 2-(2-aminoethylamino) ethanol (0.2 mol) and 56.4 g Tall oil fatty acid (0.2 mol) in 100 ml toluene. The reaction mixture is heated to reflux and water started to come out with toluene azeotrope. After that, the temperature of the mixture is raised to 160° C. and heated for 16 hours more and about 6.5 g water is collected and 72.8 g residue remained, which showed on gas chromatography with 95% pure desired product.

Formula 3

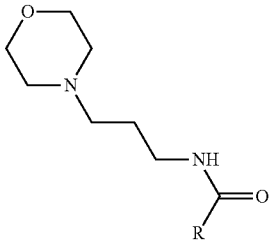

Tall-oil-amidomorpholine

To a 250 ml three-necked round bottom flask fitted with Barrett distillation receiver with condenser on the top is added 28.8 g 4-(3-aminopropyl) morpholine (0.2 mol) and 56.4 g Tall oil fatty acid (0.2 mol) in 100 ml toluene. The reaction mixture is heated to reflux and water started to come out with toluene azeotrope. After that, the temperature of the mixture is raised to 160° C. and heated for 16 hours more and about 3.0 g water is collected and 85 g residue remained, which showed on gas chromatography with 90% pure desired product.

Formula 4

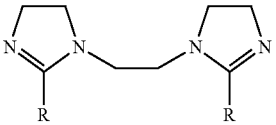

Tall oil ethylene bis-imidazoline

To a 250 ml three-necked round bottom flask fitted with Barrett distillation receiver with condenser on the top is added 25 g triethylene tetraamine (60% sample, contains 15 g pure compound) (0.1 mol) and 58 g Tall oil fatty acid (0.2 mol) in 50 ml toluene. The reaction mixture is heated to reflux and water started to come out with toluene azeotrope. After that, the temperature is raised to 175° C. and heated for 8 hours more and about 5 g water is collected and 72 g residue remained, which showed on gas chromatography with 85% pure desired product.

Formula 5

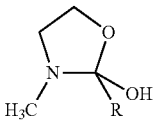

Tall oil 2-hydroxyl-3-methyloxazolidine

To a 250 ml three-necked round bottom flask fitted with Barrett distillation receiver with condenser on the top is added 25 g 2-(methylamino) ethanol (0.2 mol) and 56.4 g Tall oil fatty acid (0.2 mol) in 100 ml toluene. The reaction mixture is heated to reflux and water started to come out with toluene azeotrope. After that, the temperature is raised to 150° C. and heated for 4 hours more and about 6.5 g water is collected and 65 g residue remained, which showed on gas chromatography with 90% pure desired product.

Reagents obtained from commercial sources are as follows. Aero® 3100C a primary fatty ammonium acetate salt, Aero® 3030C a primary fatty ammonium acetate salt, and Aeromine® 8625A a primary tallow amine acetate salt, which are commercially available amines from Cytec Industries Inc, W. Paterson, N.J. Cyastat® SN (stearamidopropyl dimethyl-beta-hydroxyethyl ammonium nitrate) is a commercially available ammonium surfactant from Cytec Industries Inc. Variquat 56, 1H-Imidazolium, 1-Ethyl-2-8-Heptadecenyl)-4,5-dihydro-ethyl sulfate, Varine O 1H-Imidazole-1-Ethanol-2-(8-Heptadecenyl)-4,5-dihydro, and Varisoft 3696 Imidazolium, 1-Ethyl-4,5-dihydro-3-(2-Hydroxyethyl)-2-(8-Heptadecenyl)-ethyl sulfate are commercially available imidazoline products (Degussa Corp., Dusseldorf, Germany) of formula 2. Other examples include 1-$R_1$-4,5-dihydro-3-(2-Hydroxyethyl)-2-(8-$R_2$)-ethyl sulfate where $R_1$, could be C2-C8 and $R_2$ could vary from C14-22. 2-1-hydroxymethyl-ethyl-oxazoline, tetraethylammonium bromide, tetrabuylammonium bromide hexadecyltrimethylammonium bromide, and bezyltrimethylammonium bromide, are commercially available ammonium surfactants (Sigma-Aldrich Co., St. Louis, Mo.). Adogen 462-75% (dicocoalkyldimethylammonium chloride) is a commercially available quaternary ammonium compound from Degussa Corp., Dusseldorf, Germany.

Examples 1-20

A slurry of calcium carbonate ore (containing 2% acid insoluble impurities) is prepared by mixing about one Kg of the dried pulverized ore in sufficient water to give 33% solids. Then, 1 Kg/T on a dry basis of magnetite particles having an average particle size of 10 microns is added to the slurry followed by the addition of 1 Kg/T of various chemical additives as shown in Table 1. The pH is in the range of 7-9. After the addition of the additives, the slurry is conditioned for 6 minutes and then processed through a permanent magnetic separator filled with a nominal matrix (35 μm in diameter) at a feed rate corresponding to 6 L/hr under a 1.7 Tesla magnetic field. The slurry is fed to the magnet for 2 minutes and 30 seconds while stirring with an impeller speed of 900 rpm followed by a washing cycle. The product is collected, oven dried and the acid insoluble level (% Ins) is determined and the degree of separation is calculated as follows. Degree of separation (%)=(% Ins. Feed−% Ins. Product)*100% Ins. Feed.

Results are shown in Table 2.

TABLE 2

| No. | Chemical Additives | Additive Type | % Ins. | Degree of Separation (%) |
|---|---|---|---|---|
| 1C | None | N/A | 1.80 | 10 |
| 2 | Aeromine ® 3100C | Tallow fatty amine surfactant | 1.21 | 40 |
| 3 | Aeromine ® 3030C | Amine cationic surfactant | 1.43 | 29 |
| 4 | Aeromine ® 8625A | Tallow alkyl amine surfactant | 1.32 | 34 |
| 5 | Tetraethylammonium bromide | Quaternary ammonium surfactant | 1.56 | 22 |
| 6 | Tetrabutylammonium bromide | Quaternary ammonium surfactant | 1.50 | 25 |
| 7 | Benzyltrimethylammonium hydroxide | Quaternary ammonium surfactant | 1.37 | 32 |
| 8 | Hexadecyltrimethylammonium bromide | Quaternary ammonium surfactant | 0.60 | 70 |
| 9 | Butyl undecyl tetradecyl oleyl ammonium chloride | ammonium surfactant Formula 1 | 0.47 | 77 |
| 10 | Adogen 462-75% | Dicocoalkyl, dimethyl quaternary ammonium surfactant | 0.59 | 71 |
| 11 | Variquat 56 | Imidazoline collector | 1.00 | 50 |
| 12 | Varine O | Imidazoline collector | 1.35 | 33 |
| 13 | Varisoft 3696 | Imidazoline collector | 0.24 | 88 |
| 14 | Tall oil imidazoline | Compound of formula 2 | 0.60 | 70 |
| 15 | Ethylene bis-imidazoline | Compound of formula 4 | 1.18 | 41 |
| 16 | 2-methyl-2-imidazoline | Imidazoline surfactant | 0.93 | 54 |
| 17 | Tall oil oxazoline | Compound of | 0.74 | 63 |

TABLE 2-continued

| No. | Chemical Additives | Additive Type | % Ins. | Degree of Separation (%) |
|---|---|---|---|---|
| | | formula 5 | | |
| 18 | Tall oil amidomorpholine | Compounds of Formula 3 | 1.15 | 43 |
| 19 | Cyastat SN | stearamidopropyl dimethyl-beta-hydroxyethyl ammonium nitrate | 1.16 | 42 |

Examples 20-25

Insolubles removal from calcium carbonate ore is carried out as described in Examples 1-19, except that 1 Kg/T of magnetite particles having various particles sizes (45 micron, TB-908W from Alabama Pigments, Green Pond, Ala.; 10 microns, Iron Oxide (II, III) form Alfa Aesor, Ward Hill, Mass.; 0.1 micron, Lake 274 from Lake Industries Inc., Albany, N.Y.; 0.01 micron, TMBXT 1240 06PS2-006 form Nanochemonics, Pulaski, Va.) is added to the slurry followed by the addition of 1 Kg/T of a commercially available quaternary ammonium surfactant (Quaternary AM High Flash TSCA, Goldshmidt Chemical Corp., Hopewell, Va.). The surfactant contains tetra-alkyl ammonium chloride compound.

The results shown in Table 3 demonstrate a degree of separation that generally increases as the particle size of the magnetic particles is increased.

TABLE 3

| No. | Magnetite particle size (μm) | % Ins. | Degree of Separation (%) |
|---|---|---|---|
| 20 | N/A | 1.80 | 10 |
| 21 | 0.01 | 0.33 | 84 |
| 22 | 0.1 | 0.29 | 86 |
| 23 | 10 | 0.21 | 90 |
| 24 | 45 | 0.17 | 92 |

Examples 25-27

Insolubles removal from calcium carbonate ore is carried out as described in Examples 1-20. A slurry of calcium carbonate ore (2% acid insolubles) is prepared by mixing about one Kg of the dried ore in sufficient water to result in 33% solids. Then, 1 Kg/T of magnetite particles having an average particle size of 10 micrometer is added to the slurry followed by the addition of 1 Kg/T of commercially available phosphonium surfactants as shown in Table 4.

After the addition of the additives, the slurry is conditioned for 6 minutes and then processed through a permanent magnetic separator filled with a nominal matrix (35 μm in diameter) at a feed rate corresponding to 6 L/hr under a 1.7 Tesla magnetic field. The slurry is fed to the magnet for 2 minutes and 30 seconds while stirring with an impeller speed of 900 rpm followed by a washing cycle. The product is collected, oven dried and the acid insoluble level (% Ins) is determined.

TABLE 4

| No. | Chemical Additive | Additive Type | % Ins. | Degree of Separation (%) |
|---|---|---|---|---|
| 25 | No magnetite, no additives | N/A | 1.80 | 10 |
| 26 | CYPHOS ® 3453 | Tributyltetradecylphosphonium surfactant | 0.30 | 85 |
| 27 | CYPHOS ® IL128 | Trioctyltetradecylphosphonium surfactant | 0.12 | 94 |

Examples 28-32

Insolubles removal from calcium carbonate ore is carried out as described in Examples 1-19, except that the ratio of magnetite (TB-908W from Alabama Pigments, McCalla, Ala.) and a tetralkyl ammonium salt reagent (CP5596-93, Quaternary AM High Flash TSCA, a quaternary ammonium surfactant from Goldschmidt Corp., Hopewell, Va.) are varied keeping the total (Magnetite+Reagent) dosage content at 2 Kg/T.

The results shown in Table 5 demonstrate that the degree of separation generally increases as the dosage ratio (Magnetite/reagent) approaches 0.75.

TABLE 5

| Example | Ratio | % Insolubles | Degree of Separation (%) |
|---|---|---|---|
| 28 | 0.5 | 0.55 | 72.5 |
| 29 | 0.75 | 0.39 | 80.5 |
| 30 | 1.0 | 0.13 | 93.5 |
| 31 | 1.25 | 0.21 | 89.5 |
| 32 | 1.5 | 0.5 | 75.0 |

What is claimed is:

1. A process for the beneficiation of carbonate mineral substrates by magnetic separation, comprising:

(a) simultaneously intermixing: a plurality of magnetic microparticles and a reagent of formula I or formula II:

$$R1R2R3M \quad (I):$$

$$R1R2R3R4M^{+}X^{-} \quad (II)$$

with a carbonate-containing mineral substrate thereby forming a mixture, where

M is N or P,

X is an anionic counterion, and each of R1, R2, R3 and R4 is selected from H or an organic moiety containing from about 1 to about 50 carbons, or in which at least two of the R1, R2, R3, and R4 groups form a ring structure containing from 1-50 carbon atoms, provided that at least one of the R1, R2, R3 and R4 groups is an organic moiety containing from about 1 to about 50 carbons, or that at least two of the R1, R2, R3 and R4 groups together form a ring structure containing from 1-50 carbon atoms; and provided that the reagent of formula I or formula II is a member selected from the group consisting of: secondary amine compounds, tertiary amine compounds, heterocyclic amine compounds, secondary ammonium compounds, tertiary ammonium compounds, quaternary ammonium compounds, heterocyclic ammonium compounds, phosphonium compounds and combinations thereof; and (b) applying a magnetic field to the mixture, thereby separating a value mineral from a non-value mineral and beneficiating the carbonate mineral substrate.

2. A process according to claim 1, wherein the plurality of magnetic microparticles and the reagent of formula (I) or formula (II) are present in a weight ratio of magnetic microparticles:reagent of formula (I) or formula (II) in the range of about 10:1 to about 1:10.

3. A process according to claim 2, wherein the plurality of magnetic microparticles and the reagent of formula (I) or formula (II) are present in a weight ratio of magnetic microparticles:reagent of formula (I) or formula (II) in the range of about 5:1 to about 1:5.

4. A process according to claim 1, wherein the reagent of formula (I) or formula (II) is a member selected from the group consisting of: tallow fatty amine surfactants, amine cationic surfactants, tallow alkyl amine surfactants, secondary, tertiary, or quaternary ammonium surfactants, dicocoalkyl, dimethyl quaternary ammonium surfactants, Imidazoline or imidazole collectors, benzyltrialkylammonium surfactants, Trialkylalkenylammonium surfactants, tetraalkyl ammonium surfactants and substituted derivatives thereof, oxazoline surfactants, morpholine surfactants and mixtures thereof.

5. A process according to claim 4, wherein the reagent is a member selected from the group consisting of: methyl-bis(2-hydroxypropyl)-cocoalkyl ammonium methyl sulphate, dimethyl didecyl ammonium chloride, dimethyl-di(2-ethylhexyl)-ammonium chloride, dimethyl-(2-ethyl-hexyl)-cocoalkyl ammonium chloride, dicocoalkyl dimethyl ammonium chloride, n-tallow alkyl-1,3-diamino propane diacetate, dimethyl dicocoalkyl ammonium chloride, 2-methyl-2-imidazoline; (1H-imidazolium, 1-ethyl-2-8-heptadecenyl)-4,5-dihydro-ethyl-sulfate; 1 H-imidazole-1-ethanol-2-(8-heptadecenyl)-4,5-dihydro; Imidazolum, 1-ethyl-4,5-dihydro-3-(2-hydroxyethyl)-2-(8-heptadecenyl)-ethyl sulfate; tall oil hydroxyethylimidazoline; tall oil ethylene bis-imidazoline; tall oil oxazoline; tall oil amidomorpholine; and mixtures thereof.

6. A process according to claim 4, wherein the reagent is a member selected from the group consisting of a tetralkylammonium halide or sulfate, a benzyltrialkylammonium halide or sulfate, a trialkylalkenyl ammonium halide or sulfate and mixtures thereof.

7. A process according to claim 1, wherein the reagent is a member selected from the group consisting of tetraethylammonium bromide, tetrabutylammonium bromide, benzyltrimethylammonium hydroxide, hexadecyltrimethylammonium bromide, butyl undecyl tetradecyl oleyl ammonium chloride, stearamidopropyl dimethyl-beta-hydroxyethyl ammonium nitrate, dicocoalkyldimethylammonium chloride, tetraalkyl ammonium chloride, benzyltrimethyl ammonium hydroxide, tributyltetradecylphosphonium surfactant, trioctyltetradecylphosphonium surfactant and combinations thereof.

8. A process according to claim 1, wherein the plurality of magnetic microparticles comprises microparticles having a size in the range of from about 0.01 micron to about 100 microns.

9. A process according to claim 8, wherein the plurality of magnetic microparticles comprises microparticles having a size in the range of from about 0.1 micron to about 100 microns.

10. A process according to claim 9, wherein the plurality of magnetic microparticles comprises microparticles having a size in the range of from about 1.0 micron to about 50 microns.

11. A process according to claim 1, wherein the reagent of formula (I) or formula (II) is added in an amount that is in the range of from about 0.1 kilograms per ton (Kg/T) to about 10 Kg/T based on the carbonate mineral substrate.

12. A process according to claim 11, wherein the reagent of formula (I) or formula (II) is added in an amount that is in the range of about 0.25 Kg/T to about 6 Kg/T.

13. A process according to claim 1, wherein the magnetic microparticles are added in an amount that is the range of from about 0.005 Kg/T to about 10 Kg/T based on the carbonate mineral substrate.

14. A process according to claim 13, wherein the magnetic microparticles are added in an amount that is in the range of from about 0.25 Kg/T to about 6 Kg/T.

15. A process according to claim 1, wherein the magnetic field applied to the mixture comprises a magnetic flux greater than or equal to about 2.2 Tesla.

16. A process according to claim 1, wherein the magnetic field applied to the mixture comprises a magnetic flux less than about 2.2 Tesla.

17. A process according to claim 16, wherein the magnetic field applied to the mixture comprises a magnetic flux from about 0.1 Tesla to about 2.2 Tesla.

18. A process according to claim 17, wherein the magnetic field applied to the mixture comprises a magnetic flux from about 0.1 Tesla to about 1 Tesla.

19. A process according to claim 18, wherein the magnetic field applied to the mixture comprises a magnetic flux from about 0.1 Tesla to about 0.7 Tesla.

20. A process according to claim 1, wherein the reagent is a member of the group selected from tetraalkylammonium salts.

21. A process according to claim 1 wherein the reagent is a heterocyclic compound.

22. A process according to claim 21, wherein the heterocyclic compound is a member selected from the group consisting of: (benz)imidazoles, (benz)imidazolines, (benz)oxazoles, (benz)oxazolines, morpholines, piperidines, and combinations thereof.

23. A process according to claim 1 wherein the reagent is a phosphonium compound.

24. A process according to claim 23, wherein the phosphonium compound is a member selected from the group consisting of: tributyltetradecylphosphonium chloride, trioctyltetradecylphosphonium chloride, trimethylalkylphosphonium halide, benzyltrialkylphosphonium halide, and combinations thereof.

* * * * *